United States Patent [19]

Matz

[11] Patent Number: 5,074,972

[45] Date of Patent: Dec. 24, 1991

[54] SURFACE TREATMENT OF TI OR TI ALLOY PARTS FOR ENHANCING ADHESION TO ORGANIC MATERIAL

[75] Inventor: Christoph Matz, Oldenburg, Fed. Rep. of Germany

[73] Assignee: MBB GmbH, Bremen, Fed. Rep. of Germany

[21] Appl. No.: 581,269

[22] Filed: Sep. 10, 1990

Related U.S. Application Data

[63] Continuation of Ser. No. 937,544, Dec. 3, 1986, abandoned, which is a continuation-in-part of Ser. No. 671,185, Nov. 14, 1984, abandoned.

[30] Foreign Application Priority Data

Dec. 1, 1983 [DE] Fed. Rep. of Germany ..... 3343435

[51] Int. Cl.[5] ..... C23G 1/18

[52] U.S. Cl. ..... 205/322; 148/269; 156/644; 156/DIG. 75

[58] Field of Search ..... 204/56.1, 129.75; 156/625, 629, 634, 664, DIG. 75; 252/79.1, 79.5; 148/269

[56] References Cited

U.S. PATENT DOCUMENTS

| | | | |
|---|---|---|---|
| 2,949,411 | 8/1960 | Beck | 204/56 |
| 3,400,058 | 9/1968 | Ross | 204/56 |
| 3,829,366 | 8/1974 | Ives et al. | 204/105 R |

*Primary Examiner*—John Niebling
*Assistant Examiner*—William T. Leader
*Attorney, Agent, or Firm*—R. H. Siegemund

[57] ABSTRACT

The method proposes utilization of an alkali bath for surface treatment of titanium or titanium alloy parts, the bath being comprised of an alkali hydroxide, a titanium complex forming component, and an impurity ion-complex forming component. The bath can be alternatively applied by a simple dipping procedure or as a part of an anodizing process.

9 Claims, No Drawings

SURFACE TREATMENT OF TI OR TI ALLOY PARTS FOR ENHANCING ADHESION TO ORGANIC MATERIAL

This is a continuation of co-pending application Ser. No. 937,544, filed on Dec. 3, 1986, abandoned, which is a continuation-in-part of Ser. No. 671,185, filed Nov. 14, 1984, abandoned.

BACKGROUND OF THE INVENTION

The present invention relates to a method for surface treatment and working of pieces made of titanium or a titanium alloy by dipping the work piece into an alkali bath.

Parts made of titanium have become increasingly important in many fields of engineering, particularly and for example in the field of aircraft engineering and construction. Such a material has a very low specific weight and high strength and is, therefore, superior to other materials, even at high temperatures. Despite these advantages, it cannot be said that the utilization of titantium work pieces pose no problems. The aforementioned advantages are offset to some extend by a low wear resistance, by a strong tendency for stress corrosion and by difficult surface properties concerning adhesion to organic material. Therefore, it is necessary to pretreat these work pieces so that they can be worked at all, and can be used without the aforementioned drawbacks.

For treating or pretreating parts of titanium, it is known to use an acid bath or an alkali bath. This way one can remove portions of the material by etching. Alternatively, one may work such titanium parts through depositing or coating or by means of diffusion welding, or on a utilization of adhesive bonding.

In the case of an acid bath, one usually means hydrofluoric acid or blends with hydrofluoric acid. However, this is a very dangerous material, and its utilization is more and more abandoned. Moreover, the disposal of spent hydrofluoric acid baths is subject to very strict legal requirements rendering their utilization uneconomical in the first place. As far as alkali dipping methods are concerned, basically two types of baths are used. One type of bath has become known under the trade name "Turco 5578." The other method uses a blend of sodium hydroxide and hydrogen peroxide. The first mentioned bath, however, is suitable only for short periods of time for treatment, for example, as a preparation for a bonding or adhesive process. This is so because if a titanium part is treated in "Turco 5578" for a longer period of time than necessary for such pretreatment, one obtains an undesired coating. The second type of alkali bath permits longer treatment times, but the content of such a bath is basically instable, so that this particular method requires a rather large extent of maintenance, supervision and control.

DESCRIPTION OF THE INVENTION

It is an object of the present invention to provide a new and improved method for pretreating parts made of titanium or a titanium alloy which avoids the various aforementioned problems, and is therefore characterized by simplicity and problem-free use without requiring extensive control, supervision and maintenance.

In accordance with the preferred embodiments of the present invention it is suggested to treat, i.e., etch titanium or titanium alloy parts under utilization of an alkali bath being an aqueous solution and having the following consistency: (a) alkali hydroxide at a concentration from 0.5 to 10 m, preferably 7.5 m; (b) a titanium complex forming component at a concentration from 0.1 m to 1 m, preferably 0.33 m; and (c) an impurity ion complex forming compound at a concentration from 0.01 to 1 m, preferably 0.067; wherever "m" indicates mols per liter. The alkali hydroxide is preferably represented by sodium hydroxide (NaOH), while the titanium complex forming component is a hydroxy carboxylic acid with less than six carbon atoms or a salt thereof, such as sodium tartrate. Simple sugar derivatives such as gluconates are thus excluded because they are not useful within the content of the invention. The impurity ion-complex forming unit may be of the so-called complex-on type such as ethylene diamine tetraacetic acid (EDTA).

The inventive method makes sure that the content of the bath is able to etch parts dipped into it without the formation of undesired coatings because of the highly stable titanium complex being formed. Moreover, surfaces of parts treated in such a solution are very amenable to bonding or the formation of desired deposits such as surface protection layers. The bath content may include additionally a substance as skeleton material and substance that increase the effectiveness of a synthetic surfactant such as phosphate, silicate, borate, or preferably, sodium silicate, at a concentration of 0.02 m. These optional additive prevent extensive scattering of the amount of layer thickness removed by pickling or etching if these operations are carried out under difficult conditions, such as extreme thin or very small work pieces.

It is preferred to heat the alkali bath for carrying out the method; the temperature should be at least 30 degrees centigrade, but should not exceed 100 degrees centigrade. Particular advantageous operating and working conditions exist if the temperature is at a about 75 degrees centigrade. The period of dipping is preferably between 5 and 90 minutes, preferably about half an hour. The thickness of the resulting oxide layer is between 70 and 100 angstrom in the case of dipping.

The inventive method is, as already mentioned, basically an alkaline method, i.e., it is free from hydrofluoric acid. Moreover, it is important that the treated work pieces will not receive any undesired coating and that the surfaces treated in the inventive manner are highly suitable for bonding on coating with organic materials.

The inventive method can also be used for anodizing of work pieces made of titanium or a titanium alloy, whereby further improvements in the surface treatment of such parts are obtainable. In the case of anodizing, only the components listed above under (a) and (b) are essential, while the component (c) is optional. The same is true with regard to the skeleton forming additives mentioned above. The anodizing processing may b carried out in the following manner: The alkaline bath is subject to a voltage from 3 volts to 50 volts, preferably 10 volts, while it is heated to a temperature between normal room temperature and 60 degrees centigrade, preferably 30 degrees centigrade. The treatment period is between 2 and 90 minutes, preferably 15 minutes, and the anodizing process can alternatively be controlled through electric current control, for example and preferably to run at 1 amperes per decimeter square. The resulting layer thickness of the oxide layer is here from 1000 to 1500 Angstrom but it is a highly porous layer being a so called disturbed crystalline ratile layer.

The invention is not limited to the embodiments described above, but all changes and modifications thereof not constituting departures from the spirit and scope of the invention are intended to be included.

I claim:

1. Method for surface treament of a work piece made of titanium or titanium alloy by dipping the work piece into an alkali bath being an aqueous solution having a composition comprising:

(a) alkali hydroxide at a concentration from 0.5 to 10 mols per liter;

(b) a titanium complex forming component being hydroxy carboxylic acid with less than six carbon atoms or a salt of said acid, at a concentration from 0.1 to 1 mols per liter;

(c) an impurity ion complex forming component with a concentration from 0.01 to 1 mole per liter; and the dipping to last between 5 and 90 minutes, to obtain a highly porous oxide layer at a layer thickness between 70 and 100 Angstroms.

2. Method as in claim 1, wherein said alkali hydroxide is sodium hydroxide (NaOH).

3. Method as in claim 1, said titanium complex forming component being sodium tartrate.

4. Method as in claim 1, said impurity complex forming component being ethylene diaminetetraacetic acid (EDTA).

5. Method as in claim 1 and using in addition a substance selected from the group consisting of phosphate, silicate, and borate.

6. Method as in claim 5, said silicate being sodium silicate $Na_2SiO_3$ with a concentration from 0.02 mols per liter.

7. Method as in claim 1 and including the step of heating the bath.

8. Method as in claim 7 and including the step of heating the bath to a temperature between 30 degrees and 110 degrees centigrade.

9. Method as in claim 1, said dipping to last about half an hour.

* * * * *